US008857109B1

(12) United States Patent
Kirby

(10) Patent No.: US 8,857,109 B1
(45) Date of Patent: Oct. 14, 2014

(54) TILE-READY CORNER SEAT

(71) Applicant: Mark E. Kirby, Clearwater, FL (US)

(72) Inventor: Mark E. Kirby, Clearwater, FL (US)

( * ) Notice: Subject to any disclaimer, the term of this patent is extended or adjusted under 35 U.S.C. 154(b) by 0 days.

(21) Appl. No.: 13/628,815

(22) Filed: Sep. 27, 2012

(51) Int. Cl.

| | |
|---|---|
| ***A47K 3/16*** | (2006.01) |
| ***A47K 3/28*** | (2006.01) |
| ***A47K 3/40*** | (2006.01) |
| *E04B 1/348* | (2006.01) |
| *E03C 1/01* | (2006.01) |

(52) U.S. Cl.
CPC . *A47K 3/40* (2013.01); *A47K 3/282* (2013.01); *E04B 1/34869* (2013.01); *E03C 1/01* (2013.01)
USPC ..... 52/34; 52/36.4; 52/389; 4/612; 4/578.1; 4/571.1; 211/119.009; 211/90.01

(58) Field of Classification Search
CPC .... A47B 96/022; A47B 96/02; A47B 96/027; A47K 3/282; A47K 3/40; A47K 3/122
USPC ..... 52/34, 389, 747.11, 36.4, 36.5, 262, 52/388; 4/611, 612, 614, 378.1, 378, 4/578.1, 571.1, 573.1, 559; 211/90.01, 211/119.009, 119.011
See application file for complete search history.

(56) References Cited

U.S. PATENT DOCUMENTS

| | | | | | |
|---|---|---|---|---|---|
| 1,599,654 | A * | 9/1926 | Cranston | 211/153 |
| 2,096,024 | A * | 10/1937 | Anderson | 108/30 |
| 2,828,044 | A * | 3/1958 | Reiss et al. | 220/23.83 |
| 3,208,190 | A * | 9/1965 | Kakos et al. | 52/390 |
| 3,640,041 | A * | 2/1972 | Michieli | 52/390 |
| 5,542,218 | A | 8/1996 | Rompel | |
| 5,588,370 | A * | 12/1996 | Longley | 108/42 |
| D379,412 | S * | 5/1997 | Hampshire | D6/574 |
| 5,732,421 | A * | 3/1998 | Scherberger | 4/611 |
| 5,983,805 | A * | 11/1999 | Waluda | 108/42 |
| 5,992,654 | A * | 11/1999 | Dente, Jr. | 211/90.01 |
| 6,059,128 | A * | 5/2000 | Wang | 211/90.01 |
| 6,460,709 | B1 * | 10/2002 | Hurt | 211/87.01 |
| 6,467,224 | B1 * | 10/2002 | Bertolini | 52/177 |
| 6,640,354 | B2 * | 11/2003 | Bonack et al. | 4/611 |
| 6,739,106 | B2 * | 5/2004 | Curatolo | 52/592.1 |
| 6,851,236 | B1 * | 2/2005 | Harvey | 52/403.1 |
| 7,000,279 | B2 * | 2/2006 | Szekely | 14/69.5 |
| 7,255,236 | B1 * | 8/2007 | Sauder et al. | 211/90.01 |
| 2003/0089059 | A1 * | 5/2003 | Kirby | 52/265 |

(Continued)

*Primary Examiner* — Robert Canfield
*Assistant Examiner* — Babajide Demuren
(74) *Attorney, Agent, or Firm* — Ronald E. Smith; Smith & Hopen, P.A.

(57) ABSTRACT

A tile-ready base includes a triangular top wall disposed in a horizontal plane when the base is secured to a corner. A first side wall depends from a first edge of the top wall and abuts a first vertical wall of a building. A second side wall depends from a second edge of the top wall and abuts a second vertical wall of the building. A front wall depends from a front edge of the triangular top wall and interconnects respective forward ends of the first and second side walls. Structural support ribs underlie the top wall and enhance the structural integrity of the base. Concavities are formed in the top wall in close proximity to the first and second side walls. Each concavity receives a screw and facilitates attachment of the base to the corner. The base is installed and tiled with no delay between installation and tiling.

7 Claims, 3 Drawing Sheets

(56) References Cited

U.S. PATENT DOCUMENTS

2005/0172395 A1* 8/2005 Helmetsie et al. ..... 4/612
2006/0156637 A1* 7/2006 Blankenship et al. ..... 52/34
2008/0127409 A1* 6/2008 Rooke et al. ..... 4/614
2008/0236085 A1* 10/2008 Becker et al. ..... 52/506.08
2009/0025139 A1* 1/2009 Houpt ..... 4/578.1
2009/0077903 A1* 3/2009 Madesh ..... 52/36.4
2009/0183306 A1* 7/2009 Kik et al. ..... 4/611
2011/0168859 A1* 7/2011 Baruch ..... 248/241

* cited by examiner

TILE-READY CORNER SEAT

BACKGROUND OF THE INVENTION

1. Field of the Invention

This invention relates, generally, to seats or shelves of the type commonly installed in the corner of a shower. More particularly, it relates to a corner seat or shelf that can be tiled as soon as it installed.

2. Description of the Prior Art

U.S. Pat. No. 5,542,218 discloses a structural support base for ceramic tile corner seats and service trays. It includes a metallic triangular frame for fitting into a corner. The frame includes a triangular bottom wall, two vertical side walls, and one vertical front wall mounted about the periphery of the triangular bottom wall. The frame has an open top so that mortar can be charged into the frame. A hole is formed in the bottom wall to allow moisture to drain from the frame as the concrete cures. Horizontal flanges are formed in the front wall of the frame to support a strip of mortar outside of the triangular frame. After the concrete has cured overnight, tile is applied to the cured concrete.

The structure disclosed in said patent represents an improvement over prior art wooden frames. However, it has the serious limitation of requiring an overnight wait for the concrete to cure, just as is the case with wooden frames.

There is therefore a need for a corner seat or shelf construction that could be installed and covered with tile on the same day it is installed, thus eliminating the overnight wait and eliminating the need to return to the job site a second day.

However, in view of the art considered as a whole at the time the present invention was made, it was not obvious to those of ordinary skill in the art how the needed structure could be provided.

SUMMARY OF THE INVENTION

The long-standing but heretofore unfulfilled need for an improved apparatus for making a corner seat, shelf, or tray is now met by a new, useful, and non-obvious invention.

The inventive structure includes a tile-ready base adapted to be attached to a corner of a building structure such as a shower. The base can be secured to the corner at any preselected height. In a preferred embodiment, the height is selected so that the novel base can be used as a shower seat. The strength of the novel base supports persons of virtually any weight. However, the novel base may also be installed at a height that makes it useful as a shelf or tray to a standing person. Moreover, there may be more than one base in one shower, i.e., one for sitting upon and a more elevated one for use as a shelf or tray.

The base includes a triangular top wall that is disposed in a substantially horizontal plane having a slight downward slope to avoid water accumulation but being level enough to support items such as shampoo bottles and the like.

A first side wall depends from a first edge of the triangular top wall, normal thereto, and is adapted to abut a first vertical wall of a building structure.

A second side wall depends from a second edge of the triangular top wall, normal thereto, and is adapted to abut a second vertical wall of a building structure. The first and second vertical walls of the building structure are perpendicular to one another and therefor fit into the corner of a shower or other suitable structure.

The base further includes a front wall secured to and depending from a front edge of the triangular top wall in normal relation thereto. The front wall is disposed in interconnecting relation to respective forward ends of the first and second side walls. The side walls form a ninety degree (90°) angle where they meet, and the front wall forms forty five degree (45°) angles where it meets the first and second side walls, respectively.

At least one structural support rib is formed on an underside of the top wall to enhance the structural integrity of the base.

In a preferred embodiment, the at least one structural support rib includes a plurality of vertically disposed structural support ribs that interconnect the first and second side walls to one another. The structural support ribs are disposed substantially parallel to the front wall and preferably are in substantially equidistantly spaced relation to one another.

A central support rib for further enhancing the structural integrity of said base underlies the top wall and is disposed normal to the front wall and extends from the point of intersection of the first and second side walls to the front wall at the mid-point of the front wall.

A horizontal tile-support flange extends along the bottom edge of the front wall to support a vertically disposed tile or tiles that overlies the front wall.

A first plurality of concavities is formed in the top wall in close proximity to the first side wall and a second plurality of concavities is formed in the top wall in close proximity to the second side wall. Each of the concavities is adapted to receive a screw and enables an installer to attach the base to the corner using suitable screws.

The top wall is sloped slightly downwardly from the corner point where the two side walls meet to the front wall so that water does not collect atop said top wall.

In a preferred embodiment, the top wall has a waffle pattern formed therein to facilitate covering the top wall with tiles.

The primary object of the invention is to eliminate the overnight delay caused by tile bases of the prior art.

A closely related object is to provide a tile-ready base that can be tiled as soon as it is installed.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
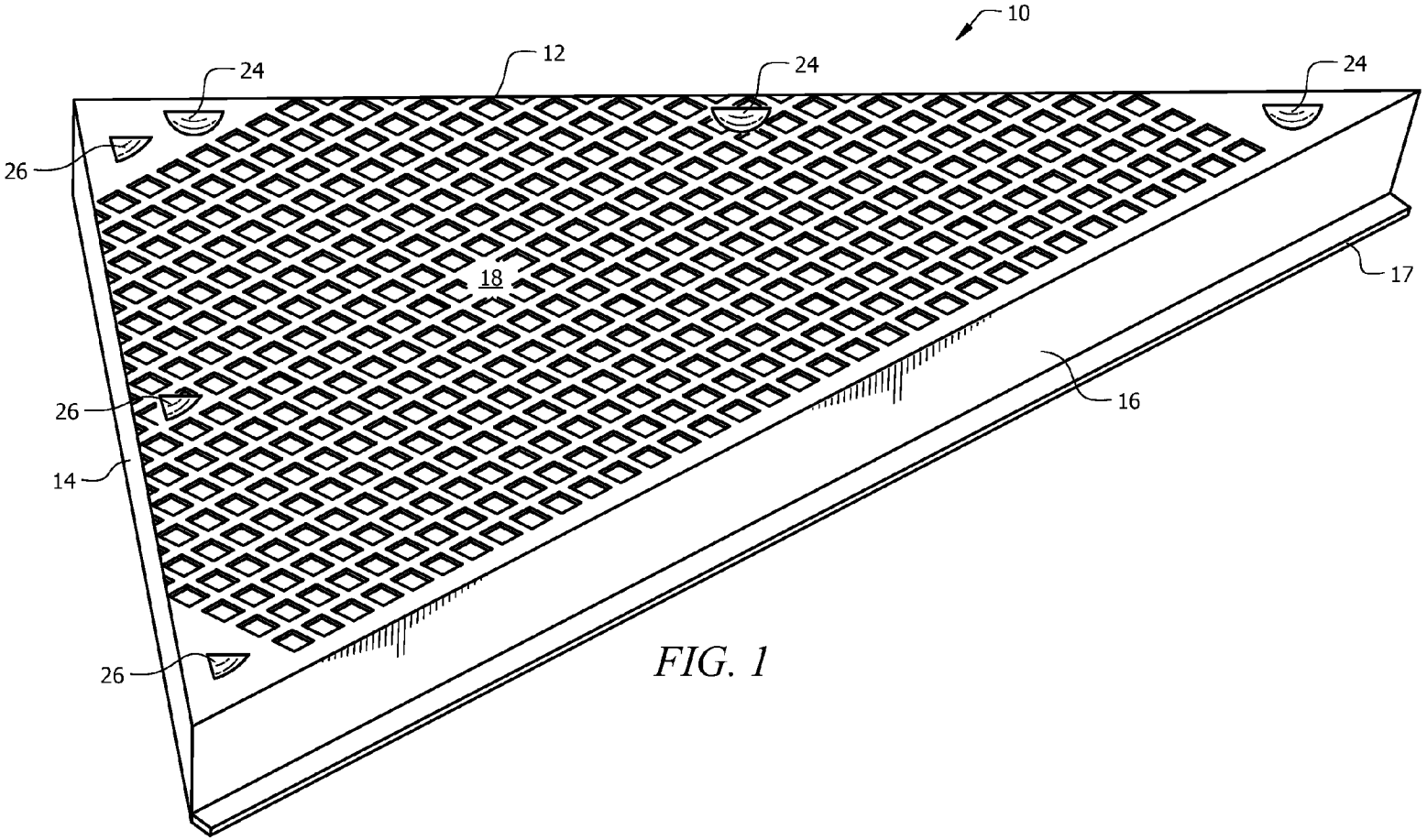
FIG. 1 is a perspective view of the top of the novel structure.
Figure 2:
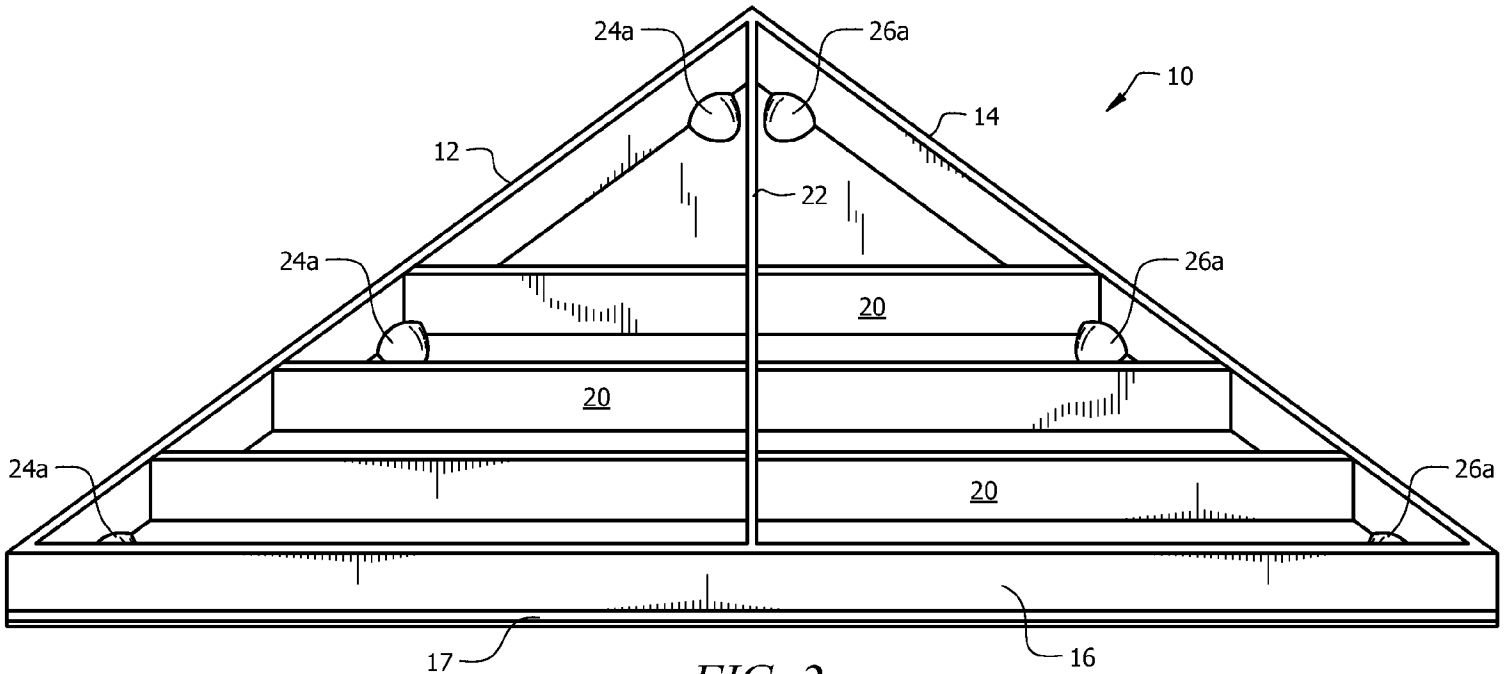
FIG. 2 is a perspective view of the bottom of the novel structure.

FIGS. 1 and 2 depict an illustrative embodiment of the novel structure which is denoted as a whole by the reference numeral 10.

Base 10 has a triangular shape and includes vertical sidewalls 12 and 14 that are adapted to fit into a corner such as the corner of a shower installation. Vertical front wall 16 interconnects the respective forward ends of sidewalls 12 and 14.

Top wall 18 preferably has a waffle pattern formed therein to enhance its functionality as a suitable support surface for tile but such waffle pattern is not required.

Horizontal flange 17 is formed along the bottom edge of front wall 16 to support one or more vertical tiles when front wall 16 and top wall 18 of base 10 are tiled.

As depicted in FIG. 2, a plurality of structural support ribs, collectively denoted 20, interconnect vertical sidewalls 12 and 14 on the underside of top wall 18 and said support ribs 20 are preferably parallel to front wall 16.

In this particular embodiment, central support rib 22 is also provided to enhance the structural integrity of base 10. Rib 22 underlies top wall 18 and is normal to front wall 16 and extends from the point of intersection of side walls 12, 14 to the mid-point of front wall 16.

Figure 3:
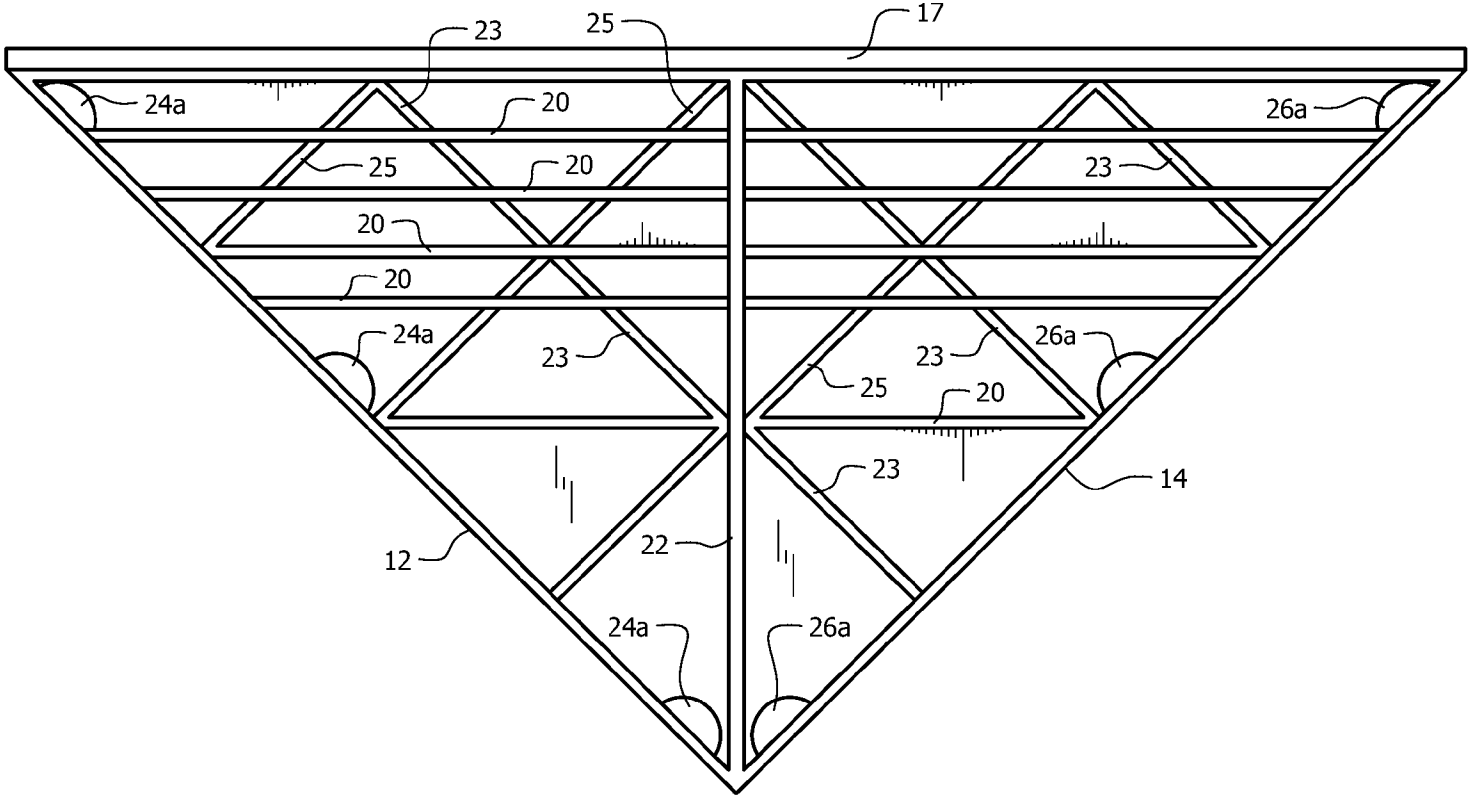
FIG. 3 is a bottom plan view of a second embodiment.

Auxiliary support ribs, denoted 23 and 25, are provided in the second embodiment of FIG. 3. Auxiliary support ribs 23 are parallel to side wall 12 and auxiliary support ribs 25 are parallel to side wall 14.

A first plurality of concavities, collectively denoted 24, is formed in top wall 18 in close proximity to side wall 12 and a second plurality of concavities, collectively denoted 26, is formed in top wall 18 in close proximity to side wall 14. These concavities enable an installer to attach base 10 to a corner using suitable screws.

Concavities 24 form convexities 24*a* in the bottom side of top wall 18 as depicted in FIG. 2, and concavities 26 form convexities 26*a* in said bottom side.

After base 10 has been secured into position at a height preselected by the installer, front wall 16 and top wall 18 are ready to be tiled. No concrete is employed in the construction of base 10 as in the prior art and thus no time is wasted while waiting for that concrete to cure. A two day job using prior art methods becomes a one day job. This allows the installer to earn the same income in one day instead of two and adds no expense to the homeowner.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A base adapted to be attached to a corner of a building structure in vertically spaced apart relation to a floor of said building structure, comprising:

a triangular top wall disposed in vertically spaced apart relation to said floor of said building structure, said top wall adapted to be tiled as soon as said base is attached to said corner;

a first side wall depending from a first edge of said triangular top wall in normal relation thereto, said first side wall adapted to abut a first vertical wall of said building structure;

said first side wall disposed in vertically spaced apart relation to said floor of said building structure;

a second side wall depending from a second edge of said triangular top wall in normal relation thereto, said second side wall adapted to abut a second vertical wall of said building structure;

said second side wall disposed in vertically spaced apart relation to said floor of said building structure;

said second vertical wall being disposed at a substantially ninety degree angle relative to said first vertical wall;

a front wall depending from a first edge of said triangular top wall in normal relation thereto, said front wall disposed in interconnecting relation to respective forward ends of said first and second side walls;

said front wall disposed in vertically spaced apart relation to said floor of said building structure;

said front wall adapted to be tiled as soon as said base is attached to said corner;

a horizontal tile-support flange formed along a bottom edge of said front wall to support at least one vertically disposed tile that overlies said front wall;

said base being hollow and having an open bottom;

a first plurality of concavities formed in said top wall in close proximity to said first side wall;

a second plurality of concavities formed in said top wall in close proximity to said second side wall;

each of said concavities of said first and second plurality of concavities adapted to receive a screw and enabling an installer to attach said base to said corner of said building structure using suitable screws;

said first side wall adapted to be secured to said first vertical wall;

said second side wall adapted to be secured to said second vertical wall;

said base adapted to be tiled in one day with no overnight curing of concrete required; and said base being supported in said vertically spaced apart relation to said floor by said screws at said first and second side walls only.

2. The base of claim 1, further comprising:

at least one structural support rib formed on an underside of said top wall to enhance the structural integrity of said base.

3. The base of claim 2, further comprising:

said at least one structural support rib including a central support rib underlying said top wall and being disposed normal to said front wall and extending from a point of intersection of said first and second side walls to said front wall at a mid-point of said front wall.

4. The base of claim 2, further comprising:

at least one auxiliary support rib disposed parallel to said first side wall.

5. The base of claim 2, further comprising:

at least one auxiliary support rib disposed parallel to said second side wall.

6. The base of claim 1, further comprising:

said top wall having a waffle pattern formed therein to facilitate covering said top wall with tiles.

7. The base of claim 1, further comprising:

said top wall having a slight downward slope from said point of intersection to said front wall so that liquid fluid does not collect atop said top wall.

* * * * *